US006419840B1

(12) United States Patent
Meincke

(10) Patent No.: US 6,419,840 B1
(45) Date of Patent: Jul. 16, 2002

(54) CLEANING SYSTEM FOR SWIMMING POOLS AND THE LIKE

(76) Inventor: Jonathan E Meincke, 120 Crickentree Dr., Blythewood, SC (US) 29016

( * ) Notice: Subject to any disclaimer, the term of this patent is extended or adjusted under 35 U.S.C. 154(b) by 0 days.

(21) Appl. No.: 09/532,245

(22) Filed: Mar. 22, 2000

Related U.S. Application Data

(60) Provisional application No. 60/127,785, filed on Apr. 1, 1999, and provisional application No. 60/126,811, filed on Mar. 30, 1999.

(51) Int. Cl.[7] ..... E04H 4/16

(52) U.S. Cl. ..... 210/767; 210/169; 210/416.2; 134/24; 134/167 R; 4/490; 4/492; 4/507

(58) Field of Search ..... 210/767, 776, 210/169, 232, 416.2; 134/22.1, 24, 167 R; 15/1.7; 4/490, 492, 507, 509

(56) References Cited

U.S. PATENT DOCUMENTS

| | | | | |
|---|---|---|---|---|
| 1,762,366 | A | * | 6/1930 | Test |
| 2,617,764 | A | * | 11/1952 | Hauber et al. |
| 3,018,491 | A | * | 1/1962 | Read |
| 3,486,623 | A | * | 12/1969 | Bosico |
| 3,521,304 | A | * | 7/1970 | Ghiz |
| 3,675,252 | A | * | 7/1972 | Ghiz |
| 4,459,209 | A | * | 7/1984 | Broadwater |
| 4,561,133 | A | | 12/1985 | Laing |
| 4,640,784 | A | * | 2/1987 | Cant |
| 4,828,626 | A | | 5/1989 | Meincke |
| 4,839,063 | A | | 6/1989 | Brooks |
| 4,907,610 | A | | 3/1990 | Meincke |
| 4,929,155 | A | | 5/1990 | Finley |
| 5,018,890 | A | | 5/1991 | May |
| 5,107,872 | A | * | 4/1992 | Meincke |
| 5,135,579 | A | * | 8/1992 | Goettl |
| 5,293,887 | A | | 3/1994 | Thibodeaux |
| 5,605,622 | A | | 2/1997 | Ferraro |
| 5,641,399 | A | | 6/1997 | Rawlins |
| 5,694,957 | A | | 12/1997 | Lee |
| 5,750,022 | A | | 5/1998 | Blake |
| 5,864,896 | A | | 2/1999 | Ferraro |
| 6,022,481 | A | * | 2/2000 | Blake |
| 6,280,639 | B1 | * | 8/2001 | Ortiz |

* cited by examiner

*Primary Examiner*—David A. Simmons
*Assistant Examiner*—Fred Prince
(74) *Attorney, Agent, or Firm*—Michael A Mann; Nexsen Pruet Jacobs & Pollard LLC

(57) ABSTRACT

A cleaning system for a swimming pool having plural active drains deployed about the bottom wall of a swimming pool and that cooperate with plural stationary nozzles mounted in the side walls that direct a flow of water down the side wall of the swimming pool. The directional nozzles dislodge debris from the side and bottom walls which is swept toward and received by the plural active floor drains, thus cleaning the pool. Additionally, the active floor drains have a grid cover that admits larger debris and does not prohibit the use of mobile pool cleaners. The active floor drains are connected to in-deck, fine mesh cannister filters to remove medium and large size debris before it reaches the water pump and balance of the pool filtration system.

20 Claims, 11 Drawing Sheets

CLEANING SYSTEM FOR SWIMMING POOLS AND THE LIKE

The present inventor claims the benefit of the filing dates of provisional patent applications No. 60/127,785, filed Apr. 1, 1999, and No. 60/126,811, filed Mar. 30, 1999, both of which are incorporated herein by reference. The present invention is a significant improvement on the inventor's previous patented pool cleaning systems, such as that described in U.S. Pat. No. 5,107,872, which is also incorporated herein by reference.

FIELD OF THE INVENTION

The present invention relates to a cleaning system for swimming pools and the like which preferably operates automatically according to a predetermnined timing sequence, and includes the possibility of employment of different types of cleaning devices.

BACKGROUND OF THE INVENTION

Historically, in the cleaning of swimming pools, suction has been used for the removal of dirt, leaves and other debris from the shell of swimming pools. Cleaning a pool manually is obviously time intensive and is generally considered a drawback to ownership of a pool. Manual cleaning involves attachment of a cleaning head to an elongated handle with wheels or the like received on the head to permit rolling along the bottom of the pool. A flexible hose is connected to the cleaning head at one end and to a skimmer at an opposite end, whereby water may be drawn through the cleaning head via the skimmer by the normal circulation system. The force of the water moving through the head creates a suction at the head which lifts trash, sediment and so forth from the bottom of the pool. Floating trash is conveyed by currents to the skimmer where it is retained in a perforated basket at the skimmer and precluded from passage to the filter system. Obviously, with such manual cleaning, and individual must move the cleaning head across the entire surface of the bottom of the pool for appropriate cleaning.

In an attempt to overcome the need for manual cleaning and thus make pool maintenance easier and keep the pool cleaner, various automatic cleaning systems have evolved. One such automatic cleaning system includes a cleaning device which is connectable to a source of water power which both supplies power for movement of the cleaning device and creates suction for the removal of the trash. While automatic cleaning systems of this type are generally successful in maintaining a clean pool, certain drawbacks are present. For example, water passed through the cleaning device for power must be pre-filtered to avoid the introduction of trash into the movement mechanism which could clog or otherwise render it inoperative. This type of automatic cleaning device also requires significant water pressure. In fact, water pressures in a range of 35 to 50 pounds per square inch are often necessary for proper operation. Normal filters used for cleaning pool water operate at significantly lower pressures, i.e. approximately 10 to 20 pounds per square inch. Also the normal pool filter media is retained in a housing designed for low pressure operation. Raising pressures in the normal filtration apparatus to the high levels mentioned above could therefore pose a hazard. Consequently, in order to avoid potential damage to the filter, including filter rupture, automatic cleaning systems of the type discussed above, normally go through the pool filtration system operating at lower pressure and include a jet booster pump located on the outflow side of the filter to raise the water pressures to the approximate 35 to 50 pounds per square inch range needed for the operation of the cleaning device.

A booster pump for this type of cleaner requires a capital expenditure for the pump. Likewise, the use of a booster pump in tandem with the normal pool pump requires additional electrical energy and, therefore, imposes an additional cost of operation. Still further, booster pumps of the type historically employed for the automatic cleaning system are merely jet pumps which receive water that has lost velocity after being forced through the filter media and they simply boost the pressure. They are short-lived, and require replacement every couple of years or so. Conversely it has been determined that in pools larger than 450 square feet of water surface area, a two pump system using two smaller horsepower pumps is actually more energy efficient and can pump more water than one larger higher horsepower pump. Moreover, when the type of pump used is identical to the pool filter pump, the life span of the pump is of longer duration than that of historically employed pressure cleaner booster pump.

It is therefore desirable to provide a cleaning system in which water is used to operate a cleaning device that moves along the bottom of the pool, but which does not require a booster water pump or energy in excess of that required for normal pool operation.

A further type of automatic cleaning that has historically been utilized for cleaning swimming pools is a total circulation system. Stationary cleaning heads are strategically located about the floor of the pool. Upon operation, water exiting from the heads dislodges trash from the surrounding pool area and moves it to a main drain in the deep end of the pool. The trash is then removed from the pool during normal water circulation to the filtration system.

Stationary cleaning heads include various designs. One design includes heads that are mounted flush with the bottom wall of the pool and, upon receipt of adequate water pressure, extend upwardly from the mounting location and rotate about an axis perpendicular to the local pool surface. Water thus exits from the head in a circular pattern to dislodge the trash and other contaminants as noted above.

A second type head mounted in a side wall of the pool in much the same fashion as a conventional water return line, but where a nozzle is provided to direct water flow in a predetermined direction for dislodging trash and contaminants and forcing them to a single area of the pool.

With both of the stationary type cleaning systems discussed above, there is a possibility that the bottom of the pool will not be completely cleaned. Additionally, the water force utilized to dislodge trash and contaminants from the side walls and bottom and move it to the main drain of the pool causes the contaminants to be suspended in the water. As a result, less than complete cleaning is experienced. After the cleaning cycle has run, the suspended matter will again settle to the bottom of the pool.

Furthermore, and perhaps most importantly, cleaning systems involving the stationary cleaning heads do not address the problem of the removal of large particles of trash such as leaves, which will not pass through a main or bottom drain in the pool. Accordingly, even with the stationary cleaning heads, a pool owner is often required to augment this cleaning system with an additional cleaning method for removal of leaves and other large contaminates.

Stationary cleaning systems of the rotary type discussed above, have been automated to permit certain of the cleaning heads to operate according to a pre-determined cleaning cycle. Still further a stationary system with both fixed and rotary heads has been employed that uses an in-deck canister with a large mesh strainer basket located between the pump and the main drain so that leaves and other large debris can be removed from the pool prior to reaching the pump strainer basket. This system utilizes a proprietary circulation configuration described as a "water curtain" which is designed to direct large objects to the area of the main drains. Unfortunately, this system often winds up with leaves and other large debris trapped in the main drain grate, also the mesh bag in the canister does little to alleviate obstruction of the filter with medium size debris such as sand and silt which greatly shortens filter cycles, and this system has extensive piping for cleaning return lines which are directly under the floor of the pool and thus inaccessible in the event any defects in the piping arise. Still further, the water curtain is difficult to maintain unless the filter is clean and water flows are optimal.

The two pump configuration used with this water curtain system pulls water through a conventional skimmer strainer basket and then sends it directly through the pump into the automatic six port hydraulic water valve and on into cleaning return lines with the strong potential for clogging and failure because of the medium sized debris such as sand and silt which passes through the skimmer strainer basket, leading to clogs either in the ports of the water valve or in the cleaning heads themselves. Additionally in large pools or pools with elaborate configurations or multiple planes of elevation, the water curtain system leaves areas that are not adequately swept with the flow currents or areas that become dead spots or trash accumulators.

Active main drains which may be employed in these type of systems have conventional main drain grates or raised slotted grates, which often cause mechanical failures of the aforementioned moveable cleaning units. The moveable cleaning units either become wedged in the grate of the main drain or between the grate and its housing. Furthermore larger leaves such as those from magnolias or oaks will usually not pass through these conventional grates.

As can be seen from the above representative or a available cleaning systems, no one system is without problems. The cleaning system of the present invention, however overcomes all of the disadvantages of the prior art systems, and is not taught or suggested thereby.

SUMMARY OF THE INVENTION

According to its preferred embodiments, the present invention is a cleaning system for a swimming pool that is characterized by plural active drains deployed about the bottom wall of a swimming pool which, when used in combination with plural stationary nozzles mounted in the side walls, receives debris swept by the wall nozzles to the active floor drains to clean the pool. Additionally, the active floor drains have a grid cover that admits larger debris and does not prohibit the use of mobile pool cleaners. The active floor drains are connected to in-deck, fine-mesh, cannister filters to remove medium and large size debris before it reaches the pump and pool filtration system.

An important feature of the present invention is the use of plural active floor drains in connection with sequenced side wall nozzles. By sequencing the nozzles, dirt and debris can be swept down the sides and toward nearby active floor drains where it can be sucked into cannister filters. This arrangement eliminates the need to sweep dirt and debris all the way from the bottoms of the side wall to the single drain in the deep end of the pool. It also eliminates the need for pop-up nozzles on the bottom of the pool in favor of active drains which are simpler and less expensive.

Another important feature of the present invention is the design of the active floor drain cover, which, by its design, curls large leaves to admit them into the drain and does not present sharp edges or obstacles to mobile cleaning systems. The present invention not only brings the main drains to the dirt but can be designed to locate main drains in planes of the pool that would ordinarily be dead spots. Additionally, not only can the flows from the cleaning return lines be sequenced or constant, so too can the flows from the active main drains also be sequenced or constant where desirable.

Obviously, the present invention also retains the feature of the inventor's past inventions whereby a mobile pressure driven or suction driven robot or robots can be added to the cleaning cycle to bring about complete cleaning coverage of all areas of the pool regardless of configuration or multiple elevation planes.

Still another feature of the present invention is the use of two or more sets of side wall nozzles, one just below the water line and one near the cove so that, when properly sequenced, dirt and debris can be moved down the wall and across part of the bottom wall to the active drains deployed there. This feature enables a complete sweep of the wall and part of the floor but without undue turbulence that would otherwise resuspend finer particulates.

Other features and their advantages will be apparent to those skilled in the art of pool cleaning technology from a careful reading of the Detailed Description of Preferred Embodiments, accompanied by the following drawings.

DESCRIPTION OF THE PREFERRED EMBODIMENTS

Figure 1:
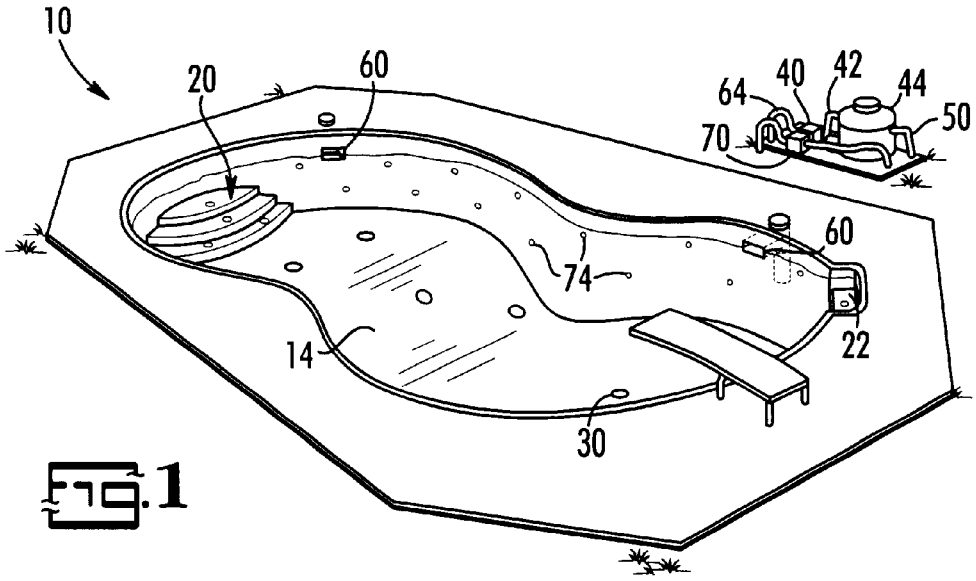
FIG. 1 is a perspective view of a typical swimming pool employing a cleaning system according to teachings of the present invention.
Figure 2:
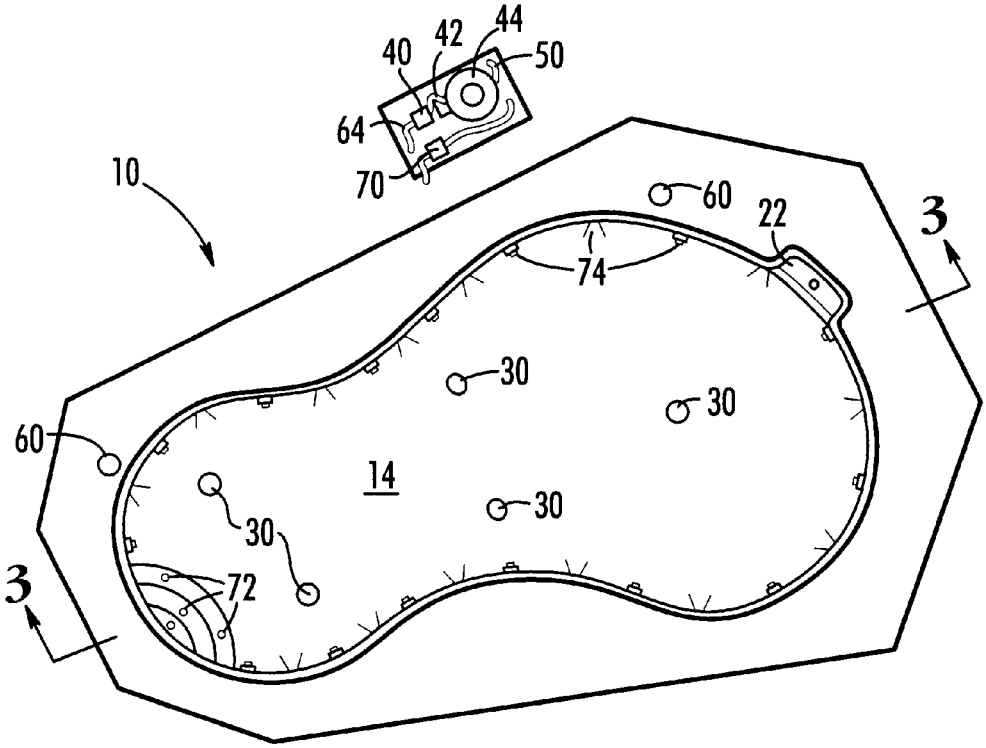
FIG. 2 is a top plan view of the pool as illustrated in FIG. 1.
Figure 3:
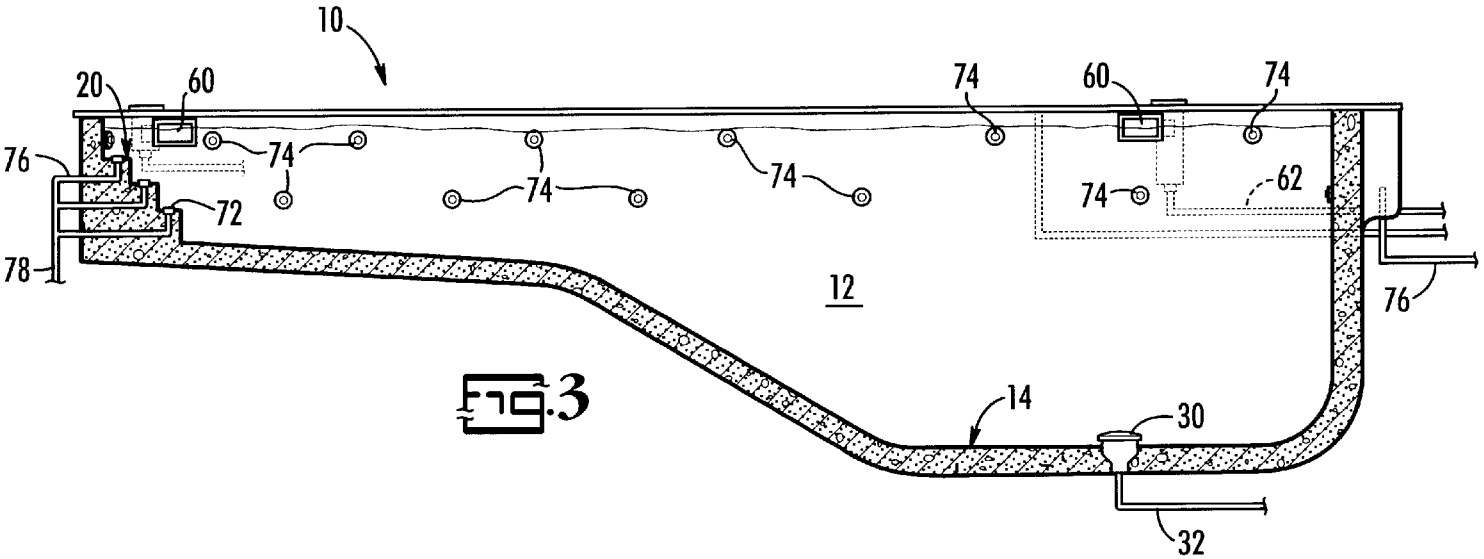
FIG. 3 is a cross-sectional view taken along a line 3—3 of FIG. 2.

Making reference to FIGS. 1–3; preferred embodiments of the present invention will now be described in detail. A swimming pool generally indicated as 10 is illustrated in FIGS. 1–3 having side walls 12 and a bottom wall 14 with the depth of the pool 10 varying along the length of same, as indicated for example, in FIG. 3. Also as indicated, a plurality of steps 20 are illustrated at one end of pool 10 for easy access to the shallow end of the pool. Likewise, at an opposite end of pool 10 a seat 22 is provided which extends downwardly along side wall 12 for a predetermined distance and provides a location where a swimmer may sit, rest or otherwise use same as a step for climbing out of the deep end of the pool. Obviously, other areas for spas or the like may likewise be provided.

Typically, such a pool installation is a gunite type pool, constructed of vertical and horizontal reinforcing bars (not shown} which line the pool shell and onto which a cementitious composition (gunite) is sprayed. With the shell excavated and prior to application of the gunite composition, plumbing lines are installed which become encapsulated by the gunite in either side walls 12 or bottom 14. For example, as illustrated, a main drain 30 is shown in bottom 14 of pool 10 with an appropriate main drain suction line 32 connected thereto and extending outwardly therefrom. An opposite end of suction line 32 would be appropriately connected to a circulating pump 40 that pulls water from the pool and through a connector line 42 feeds same to an appropriate filter system 44. Conventional water return line 50 extends from a discharge side of filter system 44 and returns water through one or more appropriate return lines 52 (see FIGS. 7*a* and 7*b*) to pool 10.

Additionally, one or more skimmers 60 are conventionally mounted in side wall 12 of pool 10 with an appropriate suction line 62 likewise connecting skimmers 60 to pump 40. Skimmers 60 are intended to remove water from the surface of the pool in order to collect leaves or other debris floating thereon. Generally, a conventional skimmer suction line 62 and main drain line 32 are brought together on the suction side of pump 40 into a common pump feed line 64 with appropriate valving to control whether water is removed from the bottom of the pool, the surface of the pool or both.

During normal operation therefore, water from pool 10 is pulled by pump 40 through main drain suction line 32 and skimmer line 62, and is then pumped to filter system 44 where the water is filtered to remove contaminants and is then returned via return lines 50, 52 to the pool. Filter system 44 conventionally is a metal or polymer structure that contains sand or diatomaceous earth filter media and operates in a general range of from about 10 to 20 pounds per square inch of pressure. Any other type filter system could, however, be employed.

Referring to FIGS. 1 and 2, in a large pool or a pool with a configuration that otherwise defeats conventional circulation patterns, additional strategically placed active main drains 30 are placed so that, with appropriate valving or timed control of pump 40 and perhaps with an auxiliary pump 70 and the use of automatic valves banks of cleaning heads, could be activated in sequence to effectuate cleaning in several zones of the pool, thus alleviating the necessity for driving all dirt and debris to the deepest portion if the pool as is commonly done with other cleaning systems.

According to the present invention, stationary cleaning heads generally indicated as 72 (see FIG. 3) may be flush mounted on the planar surfaces of steps 20 and seat 22. As illustrated in FIGS. 1, 2 and 3, plural banks of stationary cleaning heads 72 are connected via individual cleaning return lines 76 to a common cleaning return line 78 such that water passing into common cleaning return line 78 will operate all stationary cleaning units 72 in communication therewith.

Figure 4B:
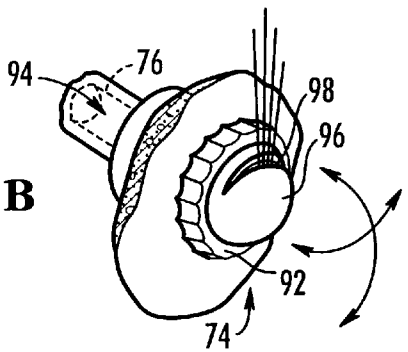
FIG. 4*b* is a perspective view of a wall mounted stationary cleaning head for use with a cleaning system according to a preferred embodiment of the present invention.
Figure 4A:
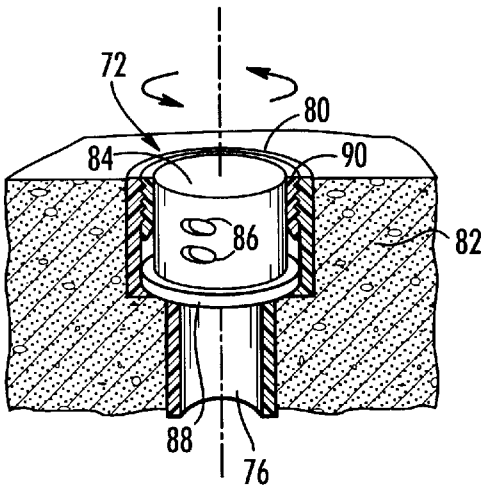
FIG. 4*a* is a perspective, partially cut-away view of a floor mounted stationary cleaning head for use with a cleaning system according to a preferred embodiment of the present invention.

As can be seen in FIG. 4*a,* stationary cleaning unit 72 includes a housing 80 positioned within the gunite 82 of the appropriate surface and with a top of housing 80 being flush with an upper surface thereof. Located within housing 80 is a hollow body 84 having one or more tangential openings 86 therein. Upon receipt of water through return line 76, body 84 will be forced upwardly by the force of the water until a flange 88 engages a portion 90 of housing 80. Water exiting tangential openings 86 will impart a rotary motion to body 84. A circular water pattern is thus created about head 72 immediately adjacent the surface thereabout which will dislodge and force away any debris or sediment thereon thus cleaning the surface. With an appropriate number of heads 72, a set of steps 20, a seat 22 or the like may thus be cleaned.

In order to clean side walls 12, near the water line and lower, at the cove or the curved juncture between side wall 12 and bottom wall 14, directional cleaning nozzles 74 are mounted in side wall 12. As illustrated in FIG. 4*b,* directional nozzles 74 include a removable fitting 92 that is threadably secured to a coupling at an end of return line 76, having a central opening 94 with a global shaped element 96 residing there within. Global element 96 includes a slot 98 through which water may be directed. The direction of water flow through directional nozzle 74 is thus determined by the position of slot 98 relative to side wall 12. In like fashion, as with stationary mounted cleaning heads 72, a plurality of directional nozzles 74 may be interconnected to form a bank of same via individual return lines 76 and common cleaning return line 78. Directional nozzles 74 can thus be employed to direct water across the surface of walls 12 to dislodge and remove loose algae, sediment or other debris therefrom. For some applications directional nozzles 74 are preferably made to sweep cyclicly through an arc of side wall 12 to direct water at pressure over the whole arc.

Banks of directional nozzles 74 are operated in sequence (best seen in FIG. 3) with an upper bank operating first to dislodge dirt and debris from just below the water line and sweep it downwardly toward the cove where a second, lower bank of nozzles 74 receives the dislodged dirt and, upon being activated, dislodges dirt and debris in the vicinity of the cove and sweeps it, together with the dirt and debris from above, toward the nearest active drain 30, or alternatively a bank can be comprised of a combination of upper and lower nozzles wherein the nozzles are activated simultaneously and as the flow from the upper nozzle begins to lose its velocity, the flow from the lower nozzle augments the flow over the cover towards the nearest active main drain.

Figure 5A:
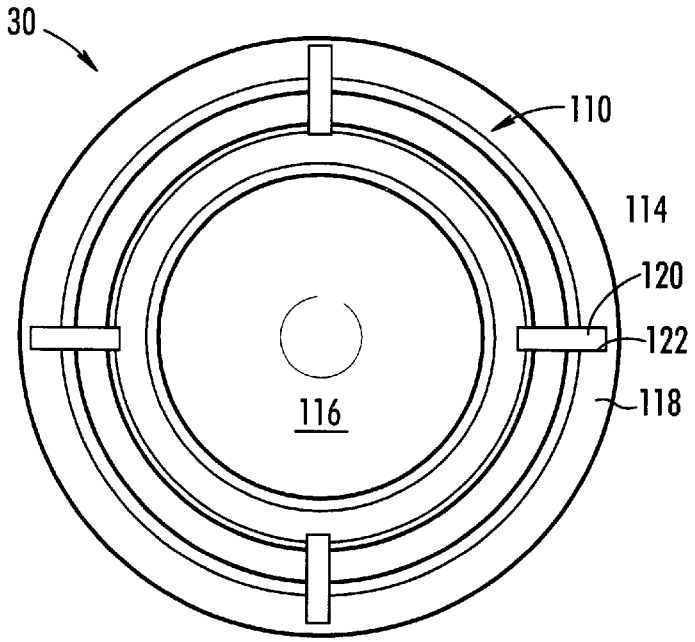
FIG. 5*a* is a top view of a floor mounted active drain, according to a preferred embodiment of the present invention.
Figure 5B:
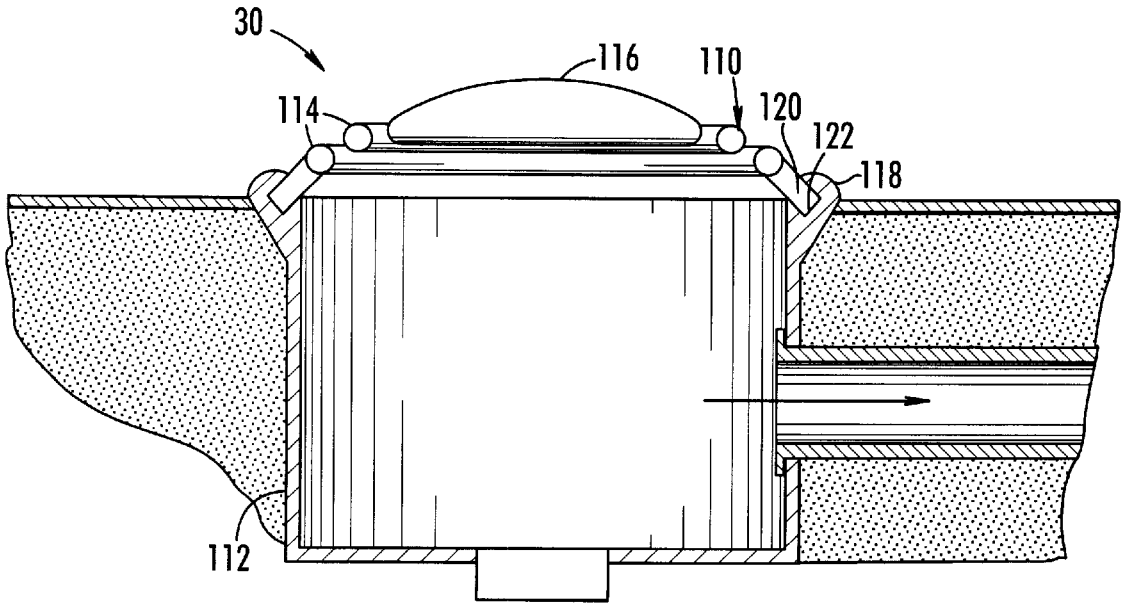
FIG. 5*b* is a cross sectional view of a floor mounted active drain, according to a preferred embodiment of the present invention.

Active drain 30 has a grate 110, illustrated in FIG. 5*a* and 5*b,* configured to curl leaves and other larger debris so that it enters drain 30 and does not have to be removed by hand or using other cleaning methods. Main drain grate 110 and an associated main drain pot 112 are shown having tubular vanes 114 staggered so that on a horizontal plane the leading edge of each vane 114 and the dome 116 of grate 110 present a rounded edge to any and all objects that are forced into contact with it. Thus the finned disc of a suction cleaner or the whip tail of a pressure cleaner, for example, would be deflected upward and away from the main drain grate whereas, conversely, leaves and other debris since they are not moving under their own power would be drawn into one of the orifices by the underlying suction from the pump 40 and the rounded edges of vanes 114 and dome 116 would help a leaf or other large waterlogged debris to conform itself so that it would be drawn through the orifice between the vanes 114 and dome 116 of grate 110.

Grate 110 would connect to pot 112 which as can be seen has a rounded raised edge 118 designed to protrude above pool floor 14 so that the aforemention staggering created by vanes 114 and dome 116 of grate 110 is furthered. Insert tabs 120 on grate 110 would seat in insert slots 122 thus locking main drain grate 110 into main drain pot 112. Obviously screws or other fastening methods could be used to further secure this connection.

Figure 6:
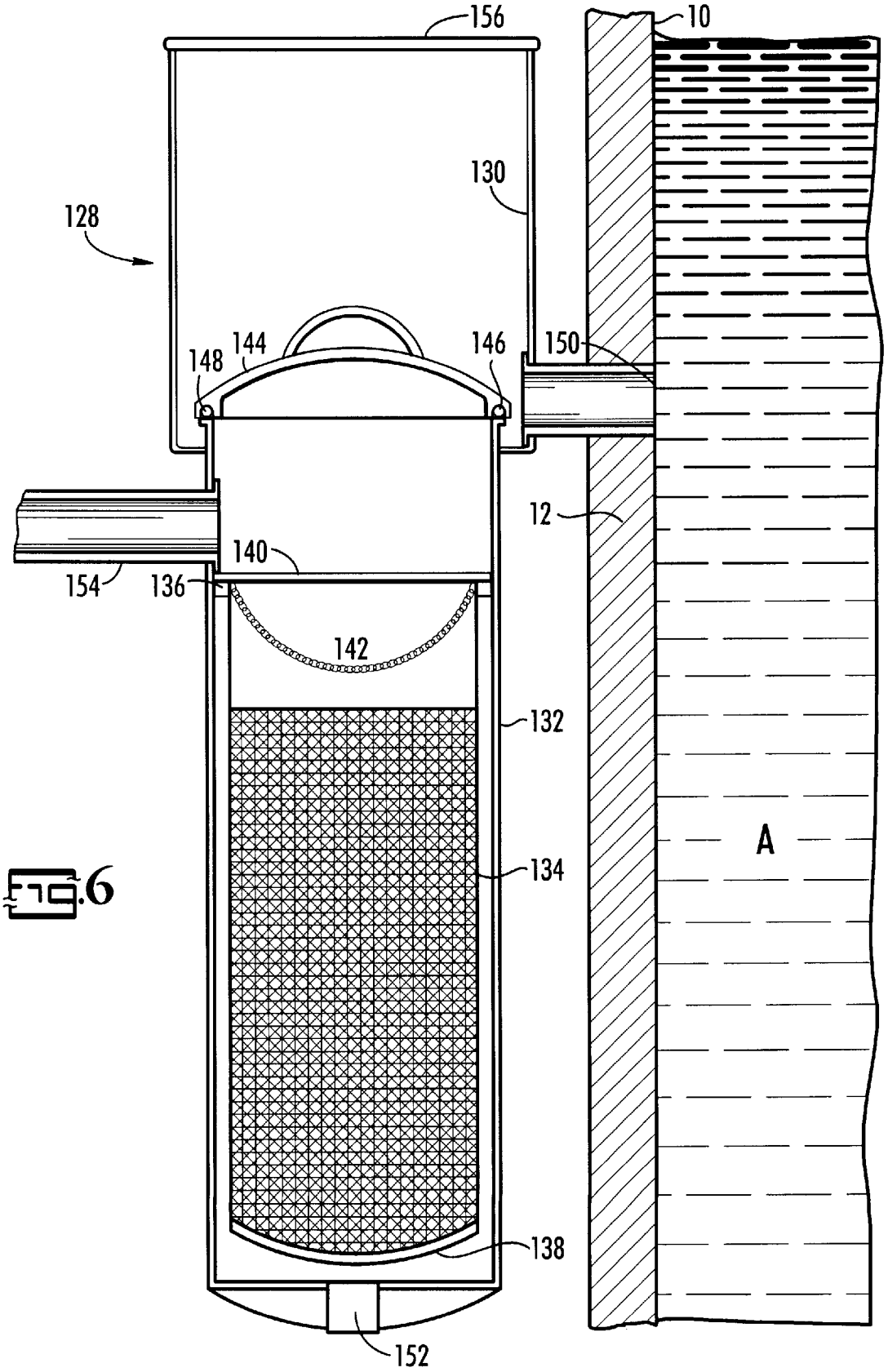
FIG. 6 is a cross sectional view of a cannister filter for use with an active floor drain, according to a preferred embodiment of the present invention.

Referring to FIG. 6, an improved form of in-deck canister 128 is shown with a wider upper housing 130 which connects to a deep narrower vertical lower housing 132 containing a large fine mesh bag 134 which is kept from collapsing by form ring 136 and weight ring 138. Mesh bag 134 is woven over form ring 136 which rests on mesh bag retention collar 140. A removal chain 142 is connected to form ring 136. A positive seal lid 144 locks has an "O" ring slot 146 and an "O" ring 148 which is seated in slot 146 just inside the lower outer edge of positive seal lid 144 when positive seal lid 144 is locked in place. An equalizer line 150 through sidewall 12 allows water "A" from pool 10 to flood over positive seal lid 144 in case a defect exists or develops either in lid 144 or "O" ring 148 thus protecting the pump connected to canister out-flow 152 from losing prime. In-flow connection 154 could be connected to active main drain 30, or, alternatively, to a mobile cleaner. A deck lid 156 fits snugly into the top of upper housing 130 and acts as a safety cover.

Under standard pool operating conditions as have been described herein above, pump 40 draws water from pool 10 via main drain 30 and/or skimmer 60 through the respective suction lines 32 and 62. Water then exits the discharge side of pump 40 and is forced through filter system 44. Within filter system 44, the water is cleaned by filter media therein and is then returned to pool 10 via normal return lines 50, 52.

Figure 7A:
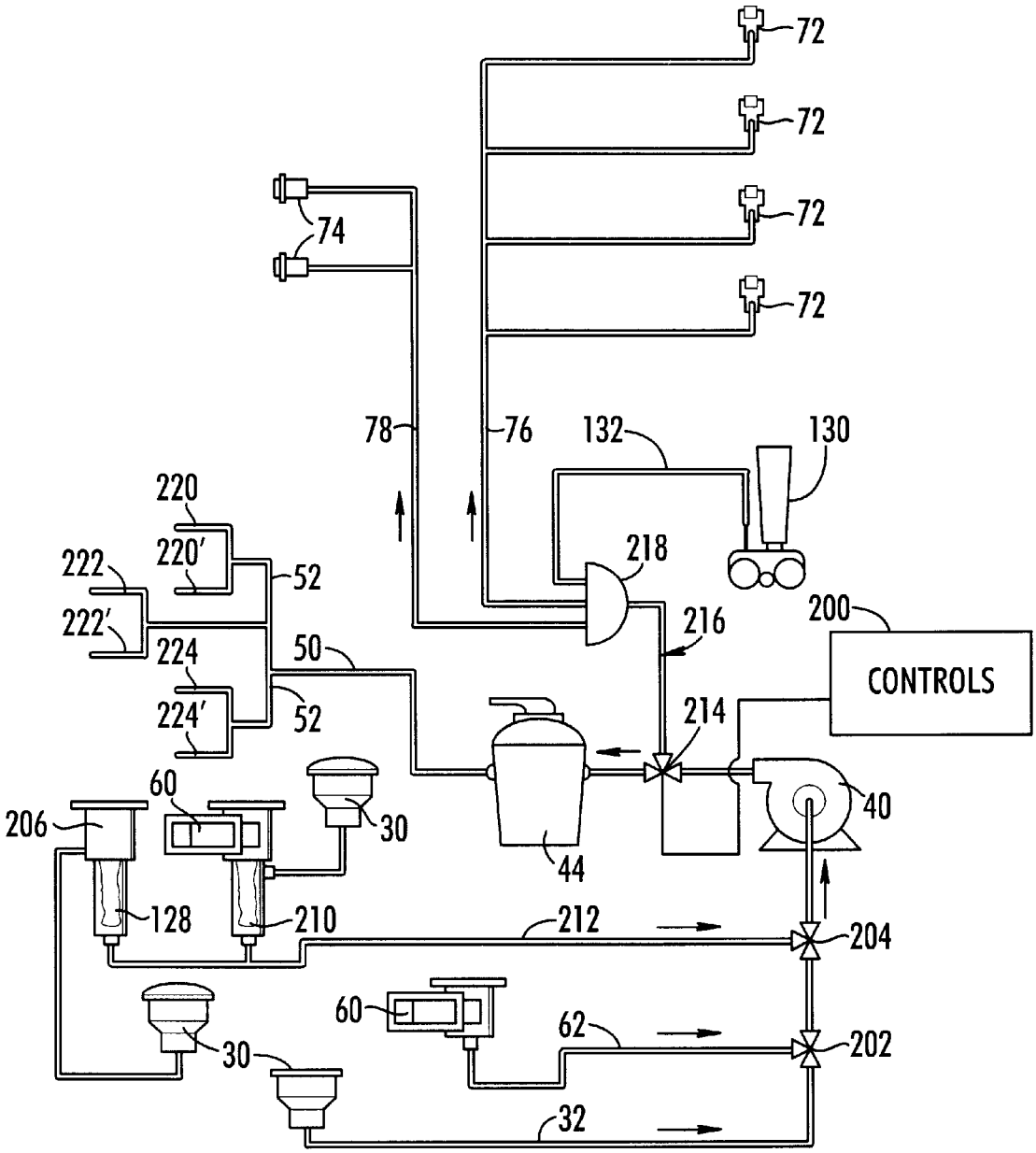
FIG. 7*a* is a schematic illustration of the plumbing connections, according to a preferred embodiment of the present invention.

In preferred embodiment illustrated schematically in FIG. 7*a,* a control means 200 automatically closes a valve 202 and opens valve 204 which causes water to be pulled from pool 10 through a filter 206 such as cannister 128 directly connected to an active main drain 30 or a skimmer 60 with an auxiliary filter 210. The water then exits filter 206 and passes via-suction line 212 to pump 40. Control means 200 also has automatically adjusted valve 214, which preferably is an automatic three-port valve, to close the valve port leading to filter system 44 and open the valve port in communication with cleaning return line 216. The water is then directed to hydraulic valve 218 preferably a HYDRA +61 valve where the water is distributed in a predetermined sequence by the opening and closing of individual valve ports of valve 218 to cleaning return lines 76 and 78 to stationary cleaning heads 72 and directional nozzles 74, respectively and potentially to a mobile device 130 through its return line 132. Control means 200 then could close valve 204, open valve 202 to pull water from main drain 3 and skimmer 60 through suction lines 32 and 62 and through pump 40. Control means 200 would then adjust valve 214 to divert flow through filter 44 into return line 50 to returns 220, 222, 224 in one set and 220', 222', and 224' in another set. Returns 220, 222 and 224 are set high and returns 220', 222', and 224' are set low in pool wall 12 and arranged circumferentially around pool to enhance the Coriolis effect during the filtration and circulation cycle. Obviously valve 214 could be adjusted to allow both the cleaning and filtration cycles to occur simultaneously albeit in a diminished capacity.

Figure 7B:
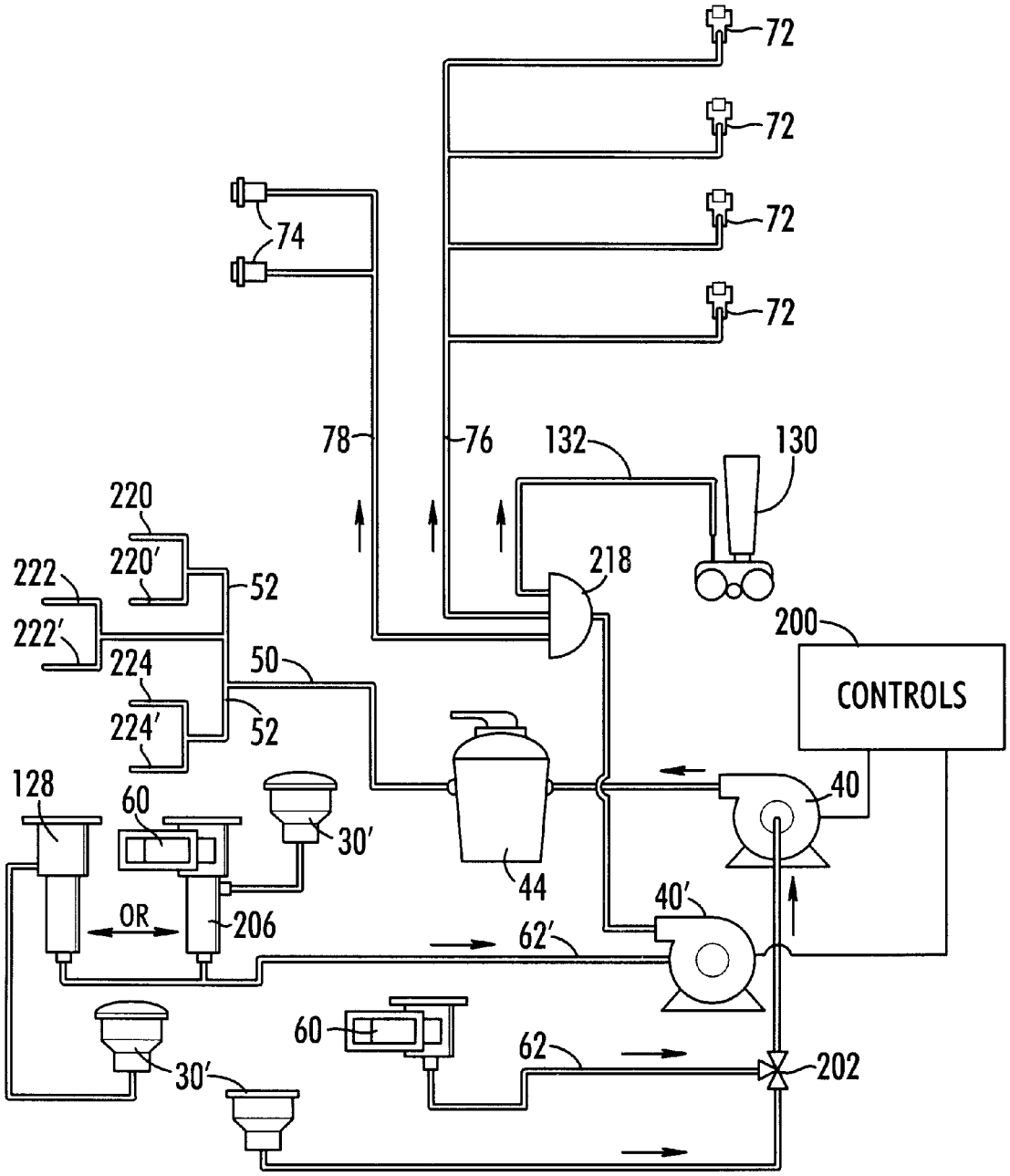
FIG. 7*b* is a schematic illustration of the plumbing connections, according to an alternative preferred embodiment of the present invention.

Referring now to FIG. 7*b* in another preferred embodiment, control means 200 activates pump 40 which draws water through either main drain 30 or skimmer 60 or both depending on the setting of three-port valve 202 as before. Control means 200 at a predetermined time activates a second pump 40' which draws water through active drains 30', then through skimmer 60 and prefilter 206 or through pre-filter canister 128 via conduit 62'. Pump 40' then forces the pre-filtered water into automatic hydraulic six-port valve 218 and then through cleaning return lines 76, 78, and 132, as before, thus accomplishing a cleaning cycle.

In a preferred embodiment, the various noted valves alluded to above are automatic, with actuation of each of the valves being controlled by control means 200. Obviously, however if desirable, certain of the valves may be manual instead of automatic or include a manual override feature such that an individual may manually operate same in the event of malfunction of control means 200, or if needed to clean the pool outside of a normal cleaning cycle. While control means 200 has been illustrated schematically, such means may be any of a number of automatic systems for opening and closing the various valves according to the particular operational cycle desired, or the conventional valves can be preset manually and activated by a time clock which initiates the action of a pump that causes flow to be diverted through these preset valves to initiate a cleaning cycle. For example, electronically operated valves or hydraulic valves may be employed in conjunction with timing clocks. For example, a "JVA 2400 JANDY" valve actuator produced by Jandy Industries, a subsidiary of Savoy Corporation, San Rafael, Calif., may be employed for operation of individual three-port valves. Additionally, a "hydra 6+one" water valve produced by Parmount Leisure Industries, Scottsdale, Ariz., in conjunction with timing clocks associated with pump 40', may likewise be employed which includes a plurality of valve ports located in a single housing with individual water lines leading to the various ports within the housing and with a timing mechanism incorporated therein for opening and/or closing the individual valve ports in a predetermined sequence. Thus, in this case, the pump acts as the valve means associated with control means 200 to activate the hydraulic valve.

Figure 8A:
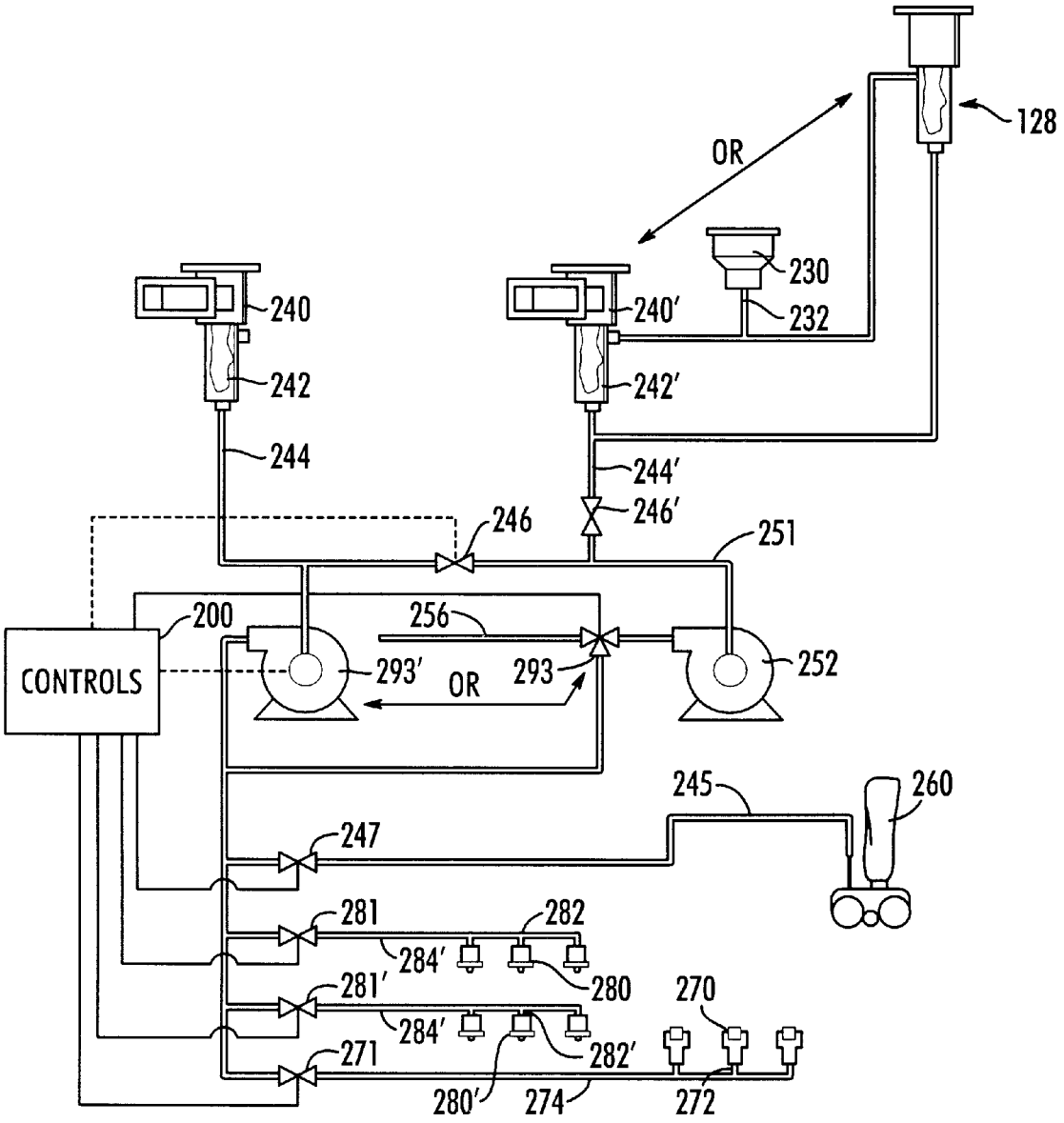
FIGS. 8*a*, 8*b*, 8*c*, 8*d*, and 8*e* are schematic plumbing diagram of further embodiments according to teachings of the present invention.

Referring to FIG. 8*a,* an embodiment of the present invention is illustrated wherein in the normal circulation system, two skimmers 240, 240', have a cartridge filter or fine mesh pre-filter 242, 242', respectively incorporated therewith, such as might be utilized with a vinyl pool. In addition to skim filters 242, 242', a drain 230 is illustrated which could be representative of a main drain in the bottom of the pool which is connected to filters 242, 242'. Skimmers 240, 240' and drain 230 are thus connected to a pump 252 via circulation lines 244, 244' respectively, which join at line 251 to feed into pump 252. Appropriate valves 246, 246' are located in lines 244, 244', respectively, to control water flow from skimmers 240, 240'. In this embodiment, of course, all of the filtration occurs at cartridge filters 242, 242' and same maybe located adjacent pump 252 instead of at skimmers 240, 240' or likewise on the discharge side of pump 252. Return lines leading from pumps 252 and connected to valve 293 are conventional return lines 256 or cleaning return lines 245, 274, 284, 284' as discussed hereinbelow.

The cartridge filters as discussed herein may by way of example be HYDRO-PAK cartridge skim filters, produced by Baker Hydro Filtrations Inc., Augusta, Ga., which include apolyester fabric cartridge located in a housing for same below the skimmer. When dirty, the fabric cartridge which generally includes 50 square feet of surface area, may be removed, cleaned with a garden hose and returned. If located on the pressure side of a pump, then of course the filter must be able to withstand the higher pressures. Alternatively, the filters on the suction side may be fine mesh pre-filters such as the pre-filter skimmer manufactured by Baker Hydro Filtrations Inc., Augusta, Ga., with fine mesh of 0.050 inch or smaller, or, for example, pre-filter mesh bags placed inside a conventional skimmer basket, the FIRST FILTER manufactured by Keith Brothers Inc. of Ponte Vedre Fla.

Cleaning return line 245 is connected to a mobile cleaning unit 260 while the return lines 274, 284, 284' are connected to stationary cleaning heads 272, 280', 280, respectively. According to this embodiment, two banks of wall mounted cleaning heads 280, 280' (three heads per bank) are included each on its separate return line 284, 284'. Once again, rather than the discharge powered mobile cleaning unit 260 of this embodiment, it is to be understood that a suction powered cleaning unit may be hooked into the suction side of the present circulation system either through one of the skimmers 240 or 240' or through a specified inlet (not shown) with an independent strainer associated therewith.

During a cleaning cycle of the embodiment of FIG. 8*a*, control means 200 would close valve 246 (or 246') if one of the skim filters is to be inoperative, and adjust valve 293 to close same in favor of manual return line 256 and open to the cleaning return lines 245, 274, 284, and 284'. Control means 200 would then sequentially open one or more of the valves 247, 281, 281 ' and/or 271 according to the desired cleaning cycle. In fact, with a plurality of banks of wall mounted cleaning heads 280, 280', about a pool, banks could be sequentially opened starting from the shallow end of the pool to wash all the pool debris to the deep end for removal through the main drain or to multiple main drains which could be located in proximity to each bank. Obviously control means 200 could open valve 246 and could activate pump 293' which in this case serves the purpose of valve 293 in FIG. 8*a* with pump 293' acting as a motorized valve, and pump 293' would serve as an additional valve opening flow to a hydra valve that would take the place of valves 247, 281, 281' and 271, thus pump 293' may serve as the control means for a valve means.

Figure 8B:
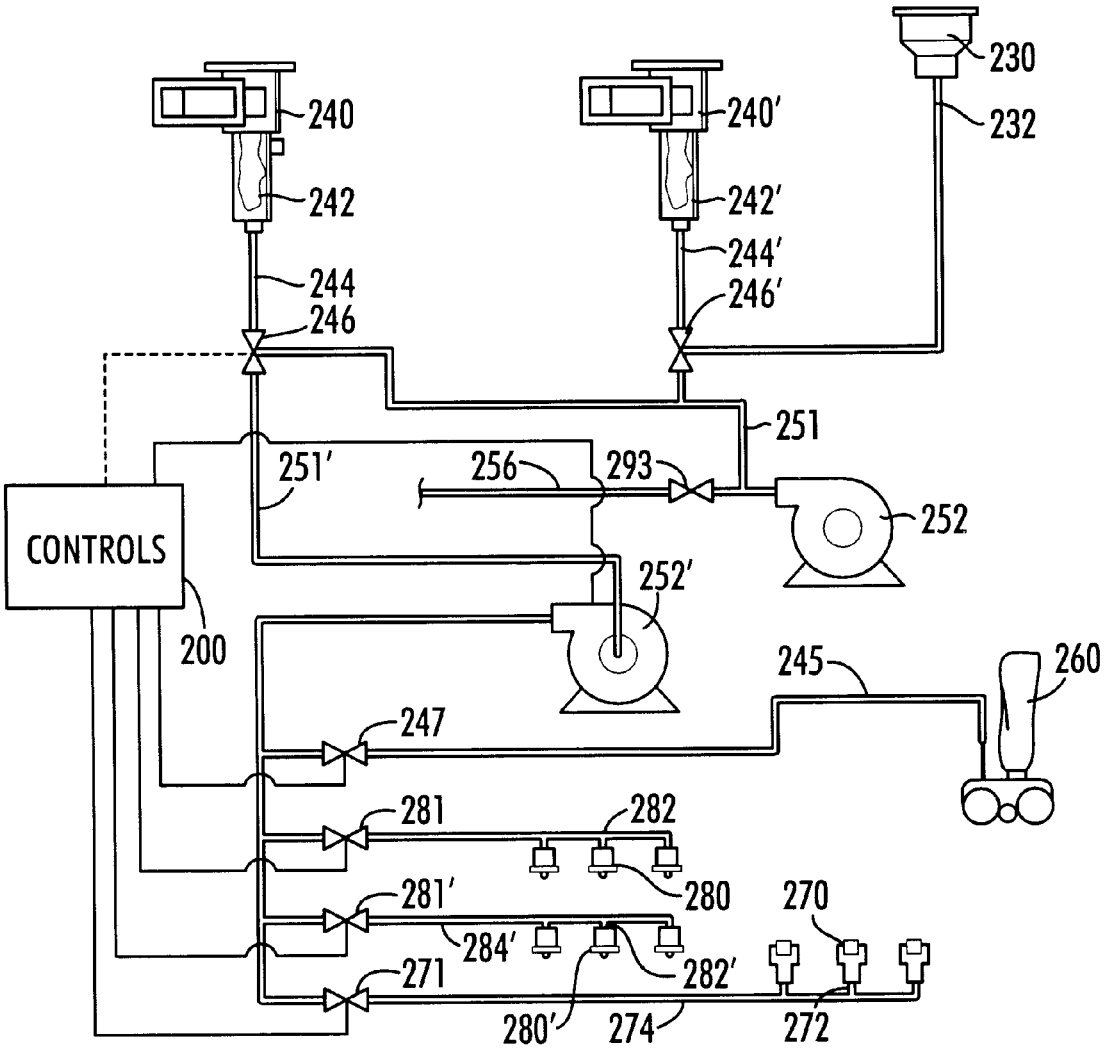

During a cleaning cycle, in the embodiment in FIG. 8B, control means 200 would open valve 246 to direct flow through line 251' and simultaneously activate pump 252' which is serving the same role as valve 293 in FIG. 8*a* and when activated would direct flow to valves 247, 281, 281' and 271 to initiate a cleaning cycle. When control means 200 deactivates pump 252' and closes valve 246 to line 251', the pool would revert to a normal circulation cycle. Although not shown, control means 200 could control pump 252 and valve 246' to allow simultaneous cleaning cycle and circulation cycle or just cleaning or just circulation.

Figure 8C:
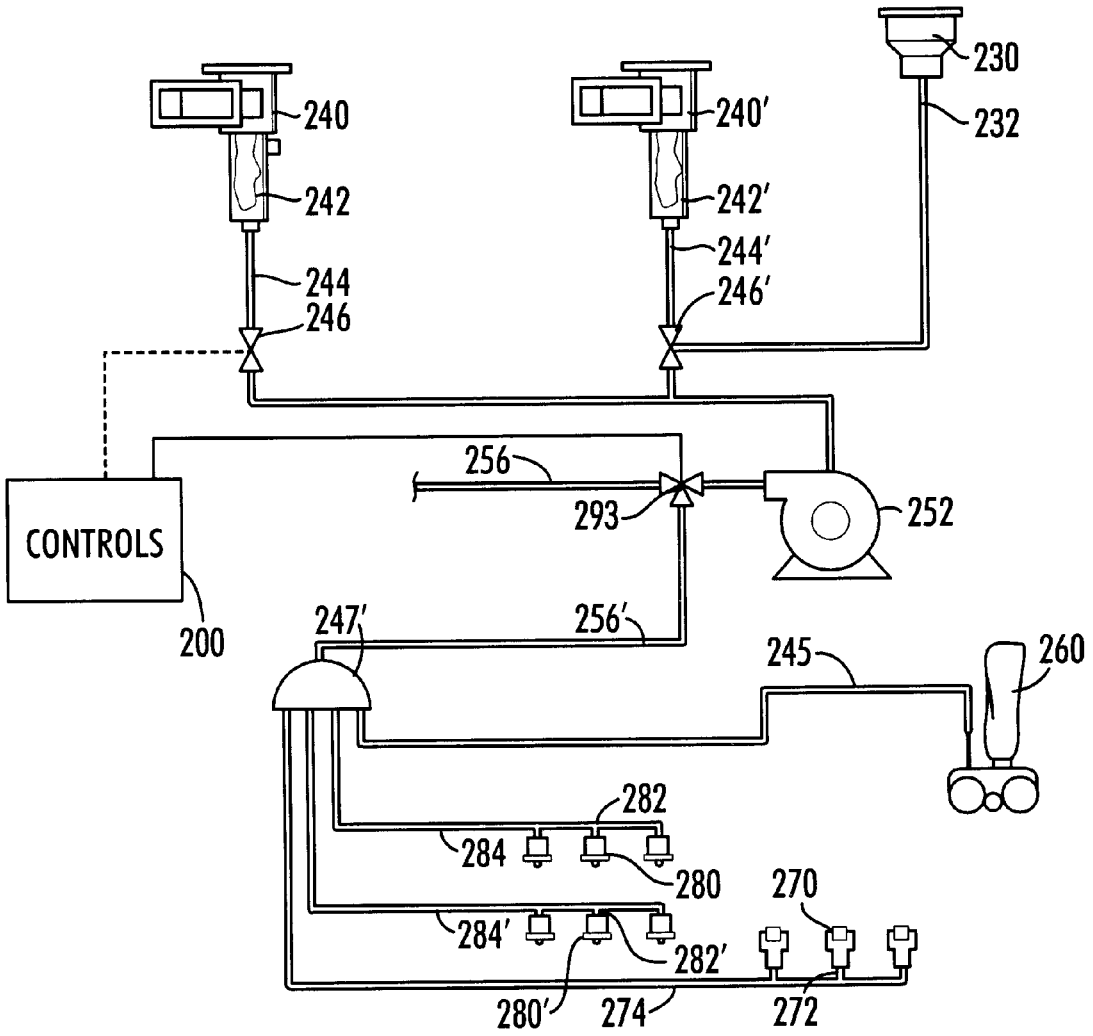

With the embodiment in FIG. 8*c* control means 200 would adjust valve 293 to close flow to line 256 ending the normal circulation cycle and initiating a cleaning cycle by directing flow through line 256' to hydraulic valve 247' which in turn would direct flow by opening and closing individual valve ports in a timed sequence to direct flow in a predetermined sequence to cleaning lines 245, 284, 284' and 274. Obviously valve 293 would not be necessary if one or more of the ports in hydraulic valve 247' were dedicated to the normal circulation line 256 in which case pump 252 would serve as the control means for valve 247' and both normal circulation and cleaning cycles could occur sequentially and at predetermined intervals.

Figure 8D:
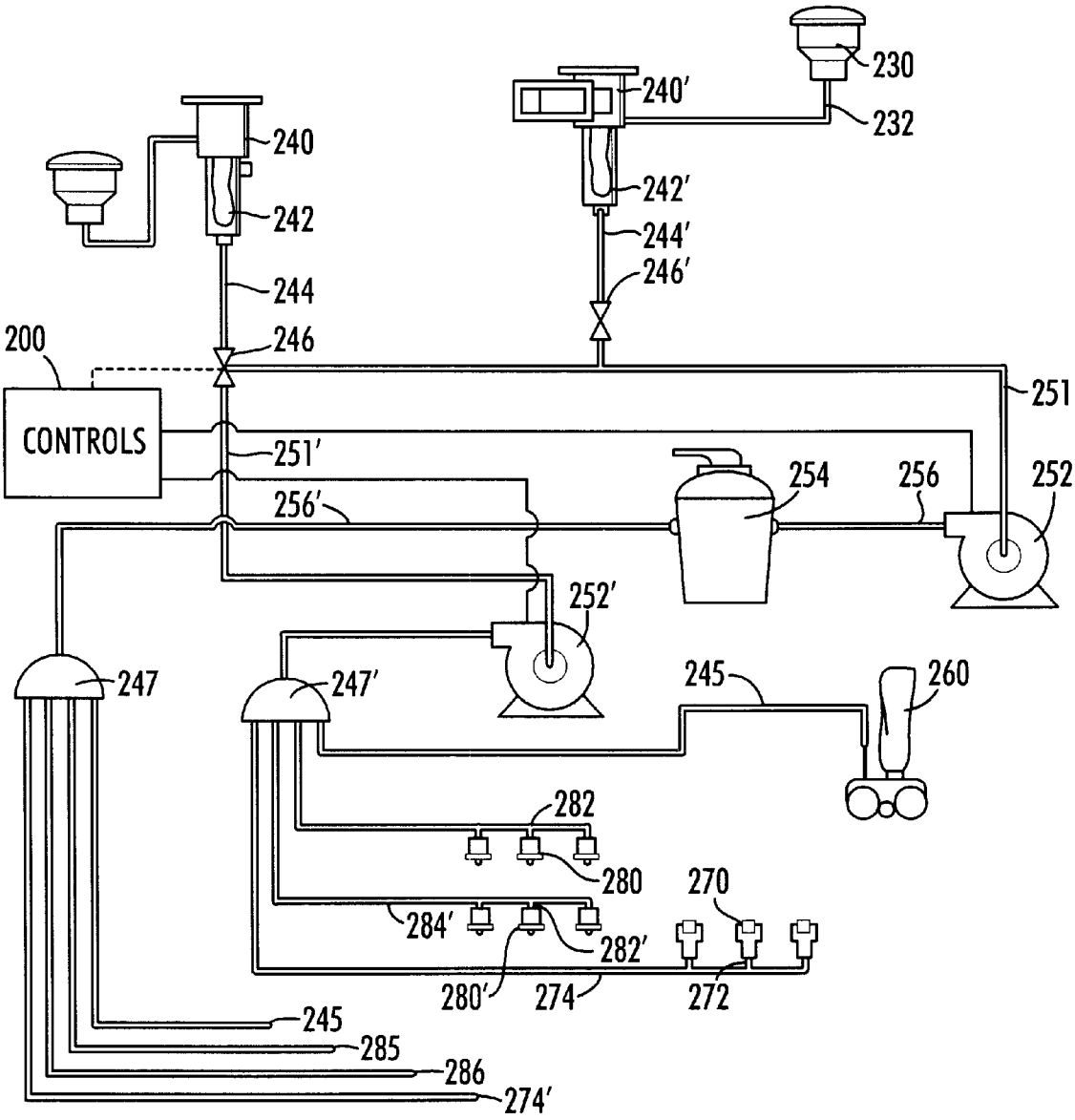

In the preferred embodiment in FIG. 8*d* which would be employed in larger pools or pools with greater hydraulic flow requirements, control means 200 would close valve 246 to line 251 and open it to line 251' and simultaneously activate pump 252' which in turn would activate hydraulic valve 247', thus initiating a cleaning cycle, as the individual valve ports in valve 247' open and close in a predetermined sequence.

Obviously, if pump 252 is not deactivated by control means 200 when it activates pump 252', it would be possible for a normal circulation cycle to be under way simultaneously with a cleaning cycle. Obviously as well in this configuration, it would also be possible to have further multiple cleaning banks or circulation banks or a combination of both controlled by the hydraulic multiport valve.

Although not shown, it is readily understood that skim filter 240' and 242' could be standard skimmers located on the suction side of pump 252 and a conventional filter 254 could be on the discharge side of pump 252 in line 256 and the water could be filtered on the pressure side of pump 252 before reentering line 256 to return to the pool through normal circulation cycle ports or cleaning head ports.

Figure 8E:
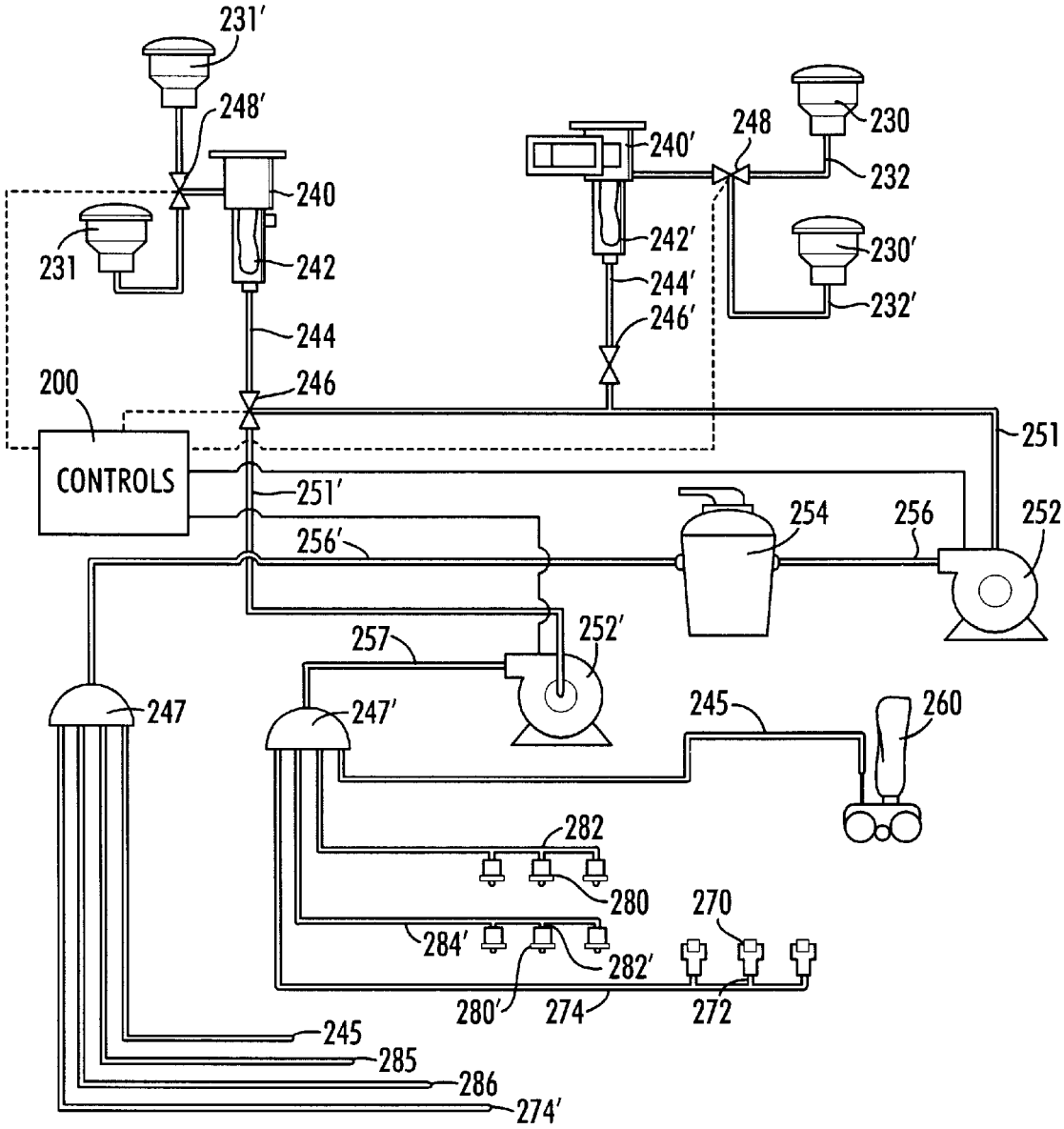

In another preferred embodiment (FIG. 8*e*) which could be employed in large pools or pools with multiple planes or complex configurations, control means 200 would sequentially open valve 248 to active main drain 230 while simultaneously activating pump 252 which would in turn activate hydraulic valve 247 via initiating flow through return line 256'. Flow through cleaning return lines 245 and 285 could be sequenced to correspond with the opening of main drain 230 and these banks would be located to direct flow towards main drain 230. Control 200 would then close flow from main drain 230 and open flow from main drain 230' to correspond with the sequencing of flow in hydraulic valve 247 from banks 245 and 285 to banks 286 and 274' with the banks being located to direct flow towards main drain 230'. Similarly, control means 200 could either simultaneously or in a predetermined sequence activate valve 248' to open flow from main drain 231 and close flow from 231' while simultaneously activating pump 252' which in turn would activate hydraulic valve 247' via initiating flow through return line 257. Hydraulic valve 247 could be sequenced to direct flow to cleaning return lines 245, 282, which would direct flow to main drain 231 and the opening of flow from main drain 231' would then correspond with the closing of banks 245 and 282 by hydraulic valve 247' and the opening of flow through cleaning return banks 284' and 274 which in turn would direct the flow towards main drain 231'.

Obviously, this sequencing could be done using electronic valves or for example in the case of larger commercial pools, could be done manually with manual valves. Obviously, another variant of this preferred embodiment would be sequencing flow from main drains in multiple areas of the pool while merely allowing hydraulic valves to sequence in their normal pattern thus allowing a randomization of which active main drains were operative in relation to directed flows by cleaning heads. This would have the effect of collecting sediment that might have been forced past one set of main drains that flow was initially towards and ultimately trapping the sediment in another more distant set of drains.

While various embodiments of the present invention have been described hereinabove, it should be pointed out that individual features of any of the embodiments may be incorporated with other individual features of other embodiments to provide a particular cleaning system. Moreover, in any embodiment illustrated having the control means incorporated therewith, obviously such system could be a manual system. Likewise, any system shown without a control means could have an automatic control means included therewith to totally automate the system.

Additionally the pump or pumps utilized in standard swimming pool configurations may serve both as a pump and a valve as it is well understood that a swimming pool pump is merely a motorized centrifugal valve and the definition of a valve as defined by the American National Standards Institute is "any device in a pipe that can partially or totally obstruct the flow of water or permit flow in on direction only."

It will be understood, of course, that while the forms of the invention herein shown and described constitute preferred embodiments of the invention, it is not intended to illustrate all possible forms of the invention. It will also be understood that the words used are words of description rather than of limitation and that various changes may be made without departing from the spirit and scope of the invention herein disclosed.

What is claimed is:

1. Apparatus, comprising:

a swimming pool having side walls and a bottom wall;

a filtration system;

a water circulation means for circulating water between said pool and said filtration system;

plural drains attached to said bottom wall of said swimming pool and in fluid connection with said water circulation means, each drain of said plural drains adapted to allow simultaneously said water circulation means to drain water from said pool; and means for directing sediment from said side walls of said swimming pool to said plural drains.

2. The apparatus as recited in claim 1, wherein said water circulation system further comprises means for filtering sediment carried by said water drained from said plural drains before said sediment reaches said filtration system.

3. The apparatus as recited in claim 1, wherein said plural drains include pots and grids, said grids having openings and vanes, said vanes and openings cooperating to curl leaves so that said leaves enter said pots.

4. Apparatus, comprising:

a swimming pool having side walls and a bottom wall;

a filtration system;

a water circulation means for circulating water between said pool and said filtration system;

plural drains attached to said bottom wall of said swimming pool and in fluid connection with said water circulation means for draining water from said pool; and means carried by said side walls for directing sediment toward said plural drains.

5. The apparatus as recited in claim 4, wherein said plural drains are deployed around said bottom wall of said swimming pool so that said plural drains can receive substantially all of said sediment directed toward said plural drains by said directing means.

6. The apparatus as recited in claim 4, wherein said plural drains drain water from said swimming pool simultaneously into said water circulation means.

7. The apparatus as recited in claim 4, wherein said plural drains are operated in sequence.

8. The apparatus as recited in claim 4, wherein said water circulation system further comprises means for filtering sediment carried by said water drained by said plural drains before said sediment can reach said filtration system.

9. The apparatus as recited in claim 8, wherein said filtering means is an in-deck cannister in fluid communication with said plural drains and said filtration system.

10. The apparatus as recited in claim 4, wherein said directing means includes plural directional nozzles carried by said side walls of said swimming pool, said plural directional nozzles directing a flow of water downward toward said bottom wall of said swimming pool, said flow of water dislodging and carrying sediment downward.

11. The apparatus as recited in claim 10, wherein said plural directional nozzles include at least two sets of directional nozzles, each set being operable independently of each other set so that said at least two sets can be sequenced.

12. The apparatus as recited in claim 10, wherein said plural directional nozzles includes a high set and a low set of directional nozzles, said high set located on said side walls of said swimming pool below said water line and said low set located on said side walls of said swimming pool above said bottom wall, said high set being above said low set of directional nozzles.

13. The apparatus as recited in claim 12, wherein said high set can be operated independently of said low set so that said high and said low sets can be sequenced.

14. A method for cleaning a swimming pool, said swimming pool having a bottom wall and a side wall, a filtration system and a water circulation system, said method comprising the steps of:

directing a flow of water from said water circulation system down said side wall of said swimming pool to said bottom wall to dislodge sediment from said side wall;

collecting said flow of water and said sediment by plural drains carried in said bottom wall;

returning said flow of water with said sediment to said water circulation system; and filtering said water with said filtration system.

15. The method as recited in claim 14, further comprising the step of filtering said sediment from said water collected by said plural drains before returning said water to said filtration system.

16. The method as recited in claim 14, wherein said sediment is filtered by an in-deck cannister through a fine mesh filter.

17. The method as recited in claim 14, wherein said directing step further comprises the step of directing said flow of water in a sequence beginning just below a water line in said swimming pool and continuing downwardly toward said bottom wall so that sediment from said bottom wall is dislodged by said flow of water.

18. The method as recited in claim 14, wherein said plural drains operate to collect said flow of water and said sediment simultaneously.

19. The method as recited in claim 14, further comprising the step of providing grids for covering said plural drains, said grids formed to curl leaves so that said leaves enter said plural drains.

20. The method as recited in claim 14, wherein said directing step further comprises the step of directing said flow of water in a sequence beginning just below a water line in said swimming pool and continuing downwardly toward said bottom wall so that sediment from said bottom wall is dislodged by said flow of water, and wherein said plural drains operate to collect said flow of water and said sediment simultaneously.

* * * * *